United States Patent [19]

Hutton

[11] 4,071,191

[45] Jan. 31, 1978

[54] TIE PLATE FASTENER SYSTEM

[75] Inventor: Charles M. Hutton, Norval, Canada

[73] Assignee: Armco Steel Corporation, Middletown, Ohio

[21] Appl. No.: 700,573

[22] Filed: June 28, 1976

[30] Foreign Application Priority Data

Oct. 9, 1975 Canada ..... 237312

[51] Int. Cl.[2] ..... E01B 9/32

[52] U.S. Cl. ..... 238/338; 238/59; 238/378

[58] Field of Search ..... 238/29, 30, 54, 59, 238/60, 61, 310, 315, 338, 348, 349, 351, 357, 358, 378, 63

[56] References Cited

U.S. PATENT DOCUMENTS

| | | | |
|---|---|---|---|
| 402,818 | 5/1889 | Gucht | 238/378 X |
| 803,775 | 11/1905 | Murphy | 238/30 |
| 911,242 | 2/1909 | Jenkins | 238/358 X |
| 1,006,309 | 10/1911 | Spickerman | 238/378 X |
| 1,013,441 | 1/1912 | Reagin | 238/338 X |
| 1,190,154 | 7/1916 | Haas | 238/348 X |
| 1,206,908 | 12/1916 | Peterson | 238/63 |
| 3,436,018 | 4/1969 | Alexander | 238/349 |

*Primary Examiner*—Robert J. Spar
*Assistant Examiner*—Randolph A. Reese
*Attorney, Agent, or Firm*—Melville, Strasser, Foster & Hoffman

[57] ABSTRACT

A tie plate fastener system for connecting a pair of spaced rails to a tie. The system includes a metallic channel tie of U-shaped cross section with the legs thereof opening downwardly and the base thereof having at each end at least one pair of openings spaced from the edges of a rail base when in position on the tie. A pair of tie plates for each rail is located on either side thereof, each plate having openings therethrough in positions corresponding to the openings in the base of the tie, and a single fastening means extends through each of the pairs of openings for securing each pair of tie plates, and thus its respective rail, to the tie.

10 Claims, 10 Drawing Figures

TIE PLATE FASTENER SYSTEM

BACKGROUND OF THE INVENTION

1. Field of the Invention

This invention relates to railway ties, and more particularly to metallic ties, tie plates and fasteners for use in underground mining.

2. Description of the Prior Art

The use and acceptance of light weight, steel section railroad ties suitable for use in both standard surface gauge and in underground mining is now attractive because the timber tie is now becoming expensive to purchase, transport, rehandle, install, maintain, and in some areas, an unreliable source of supply. The prior art, which is exemplified by such United States Letters Patents as U.S. Pat. Nos. 377,191 (H. D. Cone); 411,958 (R. Forsyth); 446,405 (E. D. DeClements); 802,764 (B. A. Legg); 826,243 (W. C. Gregg); 858,942 (A. M. Baird); 869,645 (M. J. Nolan); 1,071,161 (J. F. Lahart); and 1,214,587 (E. Prendergast), has long been concerned with the development of metallic railroad ties. However, while to some extent such prior art developments have been successful, in general the prior art railraod ties have had numerous short comings. Notable short comings include:

1. High installation time on track sections;
2. The tie cannot be applied to various gauges of railways and weights of rail;
3. There is need for measurement or gauge rods to set the rails in position;
4. Tie sections require substantial excavation at the drift floor;
5. Tie plates utilized with the tie sections do not afford sufficient protection to the tie section if derailment occurs;
6. Specialized tools are required to secure, dismantle or adjust the assembly;
7. The tie sections are unsatisfactory for track which normally requires bonding because they do not provide metal-to-metal contact in track.
8. The tie sections generally cannot be handled by miners with ease and safety.

SUMMARY OF THE INVENTION

In contrast, the tie plate fastener system of the present invention for connecting a pair of spaced rails to a tie overcomes the aforementioned disadvantages. According to the present invention, the tie plate fastener system comprises a metallic channel tie U-shaped cross section with the legs thereof opening downwardly and the base thereof having at each end at least one pair of openings spaced from the edges of a rail base when in position on the tie. A pair of tie plates for each rail is located on either side thereof, with each tie plate having forward edge portions lying substantially adjacent the sides of the rail base and a central raised and elongated portion overlying the upper surface of the rail base. The tie plates are of a width substantially identical to the width of the tie and of a length to be provided with openings therethrough in positions corresponding to the openings in the base of the tie. A single fastening means extends through each of the pairs of openings for securing the pair of tie plates, and thus its respective rail, to the tie.

DESCRIPTION OF THE PREFERRED EMBODIMENTS

Figure 1:
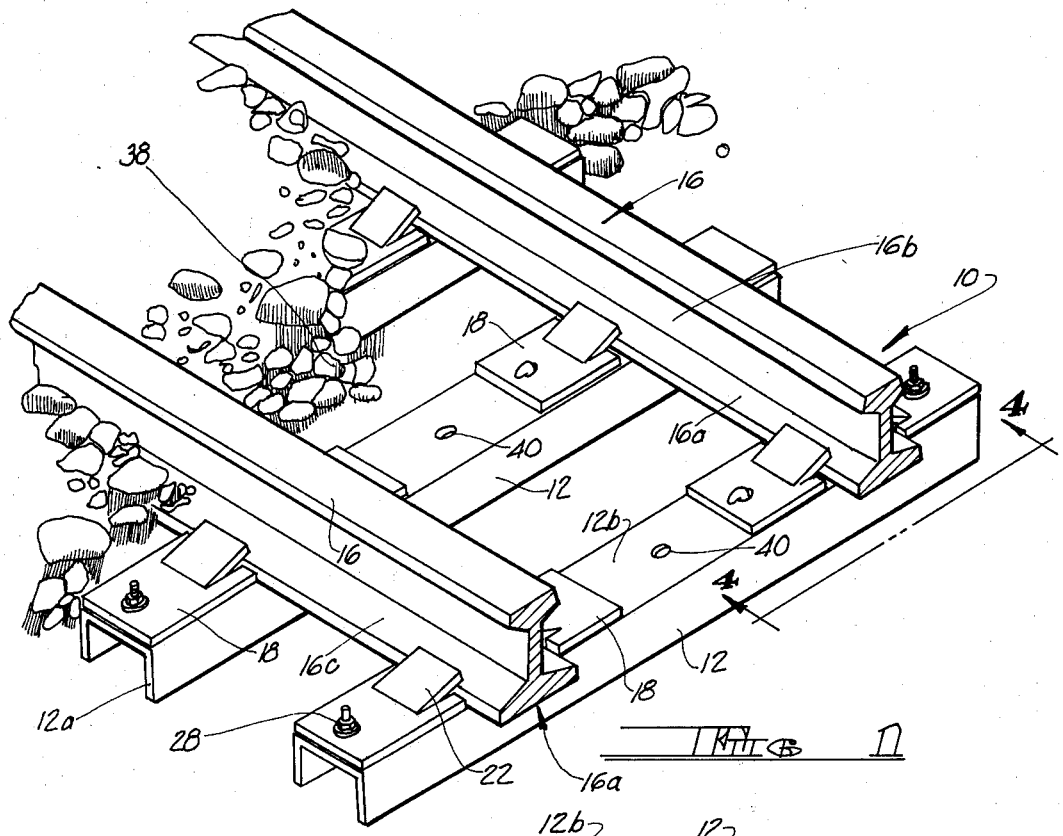
FIG. 1 is a perspective view of a track section incorporating the tie plate fastener system in accordance with the instant invention.
Figure 2:
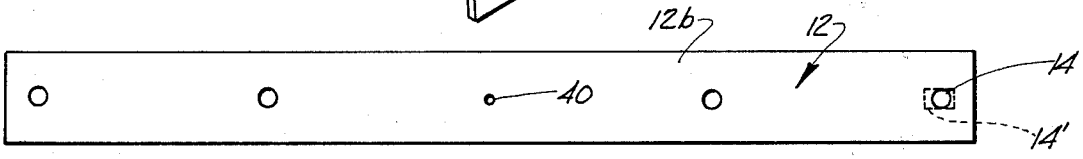
FIG. 2 is a plan view of an exemplary railway tie in accordance with the instant invention.
Figure 3:
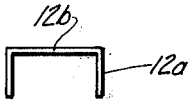
FIG. 3 is an end plan view of the railway tie of FIG. 2.
Figure 4:
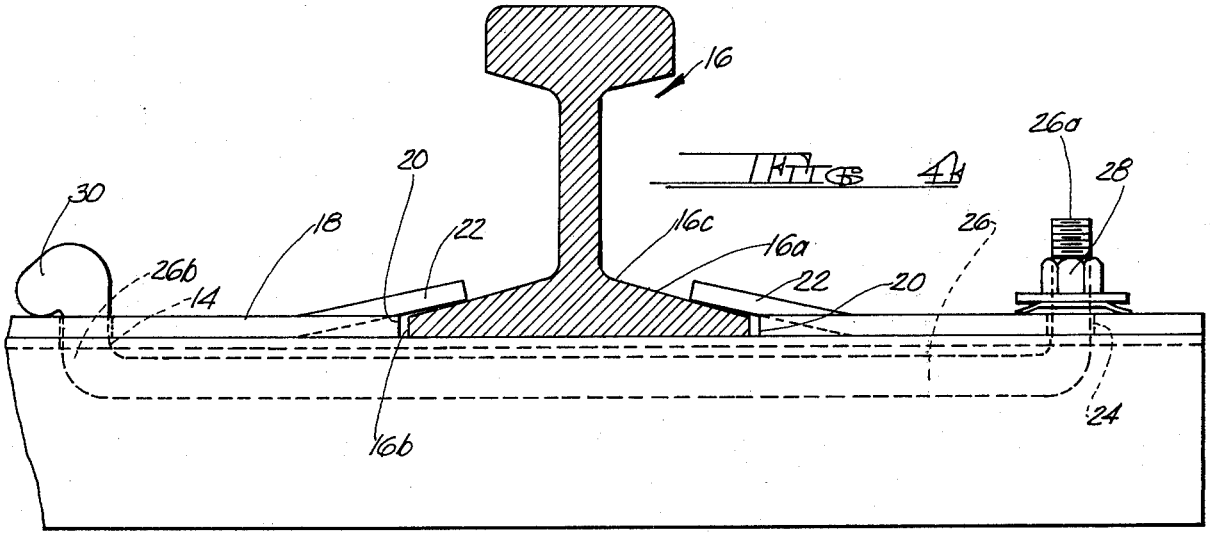
FIG. 4 is a cross sectional view taken along the lines 4—4 of FIG. 1.

Turning now to FIGS. 1 through 4 of the drawings, it will be seen that the tie plate fastener system 10 of the present invention comprises a metallic channel tie 12 of U-shaped cross section with the legs **12*a* thereof downwardly and the base 12*b* thereof having at each end at least one pair of openings 14 spaced from the edges 16*b* of the base 16*a* of the rail 16 when in position on the tie 12**.

A pair of tie plates 18 is provided for each rail 16 and located on either side thereof. Each tie plate 18 is provided with forward edge portions 20 lying substantially adjacent the edges or sides **16*b* of the base 16*a* of the rail 16 and a central raised and elongated portion 22 overlying the upper surface 16*c* of the rail base 16*a*. The tie plates 18 are of a width substantially identical to the width of the ties 12, i.e, the width of the base 12*b* of the tie 12, and of a length to be provided with openings 24 therethrough in positions corresponding to the openings 14 in the tie 12**.

A single fastening means 26 extends through each of the pairs of openings 14 in the base **12*b* of the tie 12 for securing each pair of tie plates 18, and thus its respective rail 16, to the tie 12. As can be seen, the fastening means 26 generally comprises a U-bolt having an elongated base and upstanding legs, the legs being of a length just sufficient to enable mounting of the U-bolt with the elongated base portion thereof lying just under the underside of the base 12*b* of the tie 12. The free end 26*a* of one of the legs is threaded and provided with a nut 28 and the free end 26*b* of the other of the legs is hook shaped 30, with the hook shaped end 30 extending outwardly and away from the rail 16. As can be seen, the hook shaped end 30 and the nut 28 bear against the tie plates 18 and secure them tightly against the base 12*b* of the tie 12, with the central raised and elongated portion 22 contiguous with the upper surface 16*c* of the base 16*a* of the rail 16**.

The aforementioned single fastening means 26 of present invention provides a simple and reliable method of connecting the basic tie section 12 to the base **16*a* of the rail 16. The heavy steel tie plate 18 provides a stable base for the cross connecting U-bolt 26, as well as providing a protective "armour" adjacent to the rail 16, with the hook 30 and the nut 28 being so located as to be well clear of the rail 16 so as to reduce vulnerability during derailment, which usually occurs at low speed (say 4 mph) with the initial impact and drag adjacent to the rail 16. In this regard, it has been found that the pair of openings 14 in the base 12***b* of the tie 12 should preferable be spaced at least twice the width of the base 16*a* of the rail 16.

Resistance to a "pull through" type of failure at the fastening means 26, is a feature of the present invention, since the bolt holes 14 in the tie 12 are protected by means of the heavy steel plates 18 held in position by the cross-connecting U-bolt 26. Accordingly, no single hole 14 or bolt 26 is subjected to the entire load at any time, but the load is distributed between the two ends 26*a* and 26*b* of the cross-connecting U-bolt fastening means 26.

Figure 9:
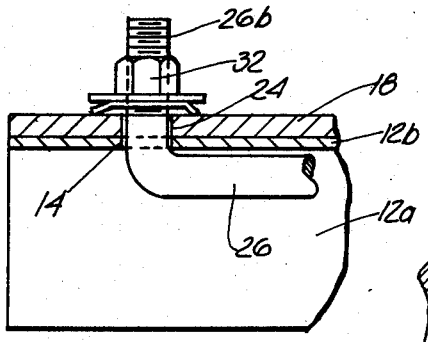
FIG. 9 is a fragmentary sectional view showing an embodiment of the U-bolt fastener means wherein both ends thereof are threaded and provided with nuts.

While it is preferred that the end 26*b* of the U-bolt 26 on the inside of the track be provided with a hook shape 30, since when maintenance crews clean ore, coal, fill, etc. from the inside of the tracks, damage to a protruding fastener is minimized, a threaded end with a nut 32 may be substitited for the hook shape, as shown in FIG. 9.

Figure 5:
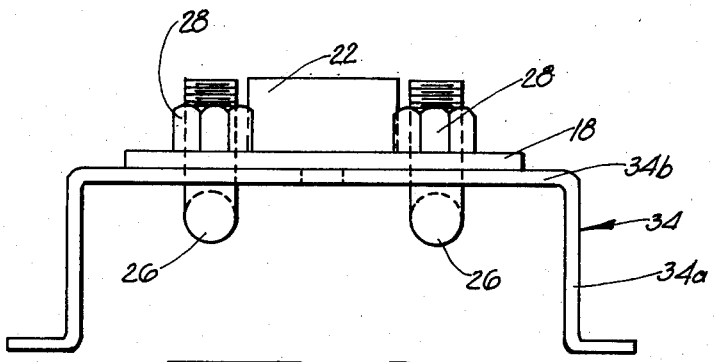
FIG. 5 is an end elevational view of a further embodiment showing a variation of fastening means.

A study and evaluation of manufacturing methods, operating conditions and insulation techniques underground indicates that a relatively light weight (i.e., 30 pounds total assembly) steel section, is perhaps the most advantageous for the basic tie section 12, since it is easily transported, rehandled and installed and provides reliable and accurate gauge on both straight and curved track or turnouts. While a preferred tie section 12 comprises a metallic channel tie of U-shaped cross section with the legs 12*a* thereof opening downwardly, a modified channel or "hat section" 34, as shown in FIG. 5, may also be utilized. The use of these sections is principally a matter of preference or dictated by operating conditions. While the channel section 12 is perhaps a little easier to transport, handle and install in the ballast material 38, the hat section 34 has the advantages of additional section modulus and strength, which minimizes the necessity to provide completely even ballast support. Furthermore, in major traffic areas of large underground mines where the track is set in concrete, the hat section 34 provides the strongest anchorage.

Figure 6:
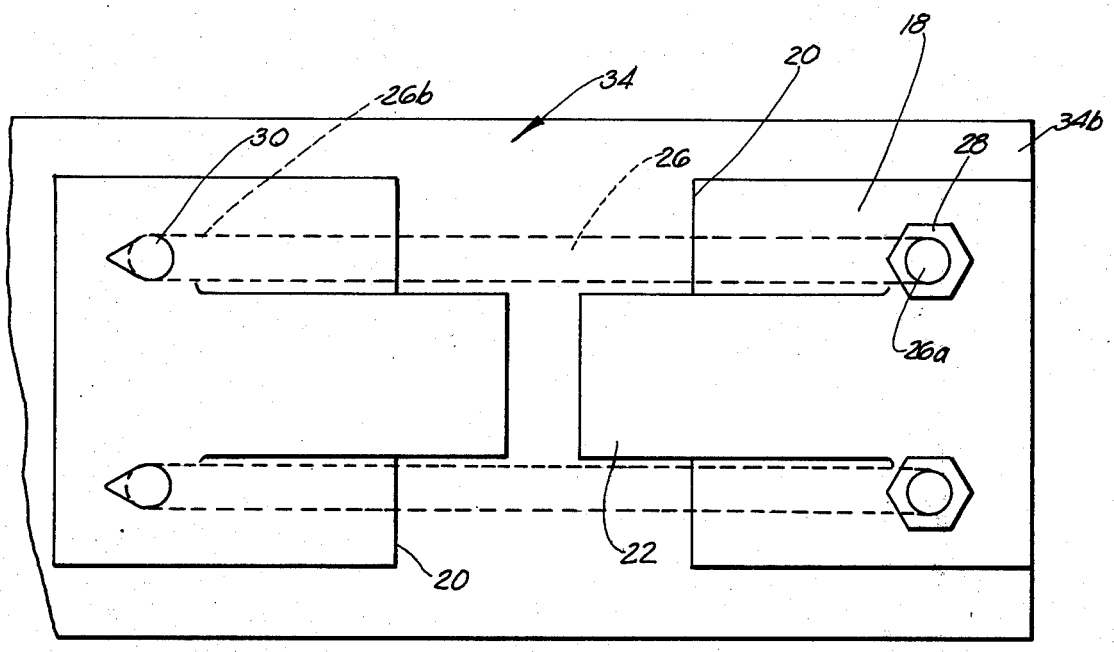
FIG. 6 is a plan view of the embodiment of FIG. 5.

While it has been found that it is generally satisfactory if the base 12*b*, 34*b* of the ties 12, 34 are provided at each end with one pair of openings 14 spaced from the edges of the base 16*a* of a rail 16 in position on the tie 12, a tie 12, 34 for exceptionally heavy rail 16 may very well be of a width which requires the use of two pairs of openings 14, as indicated in FIGS. 5 and 6.

Figure 7:
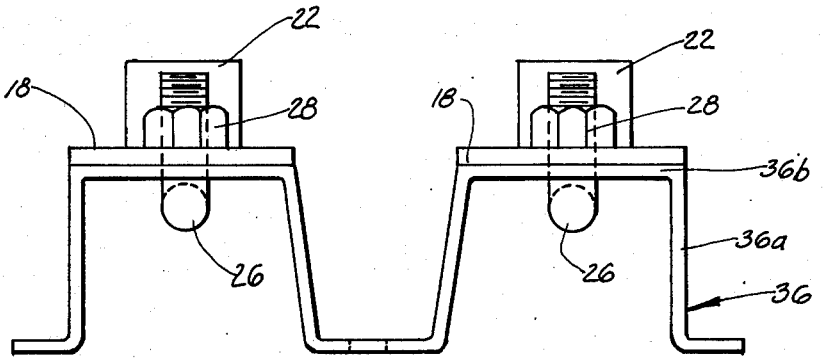
FIG. 7 is an end elevational view of a further embodiment of a railway tie of the present invention.
Figure 8:
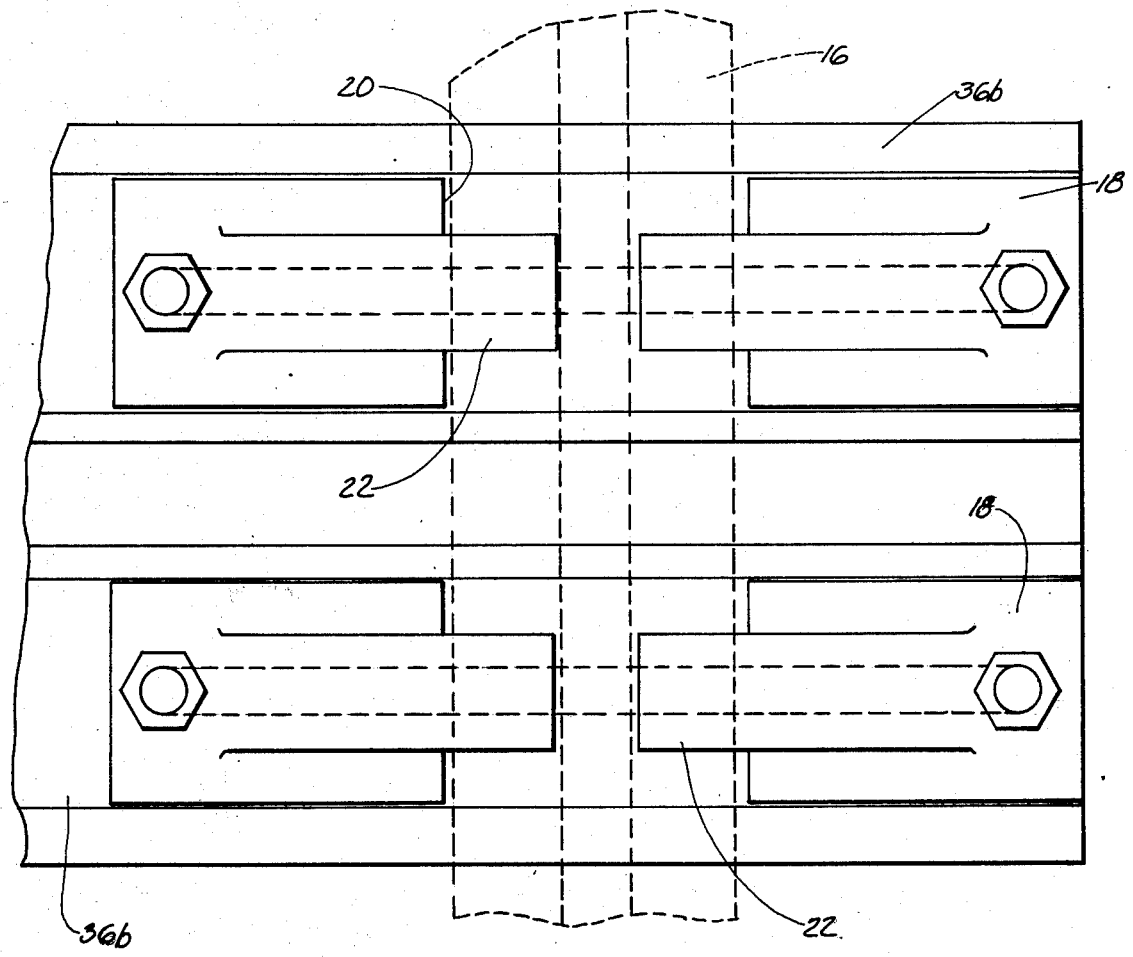
FIG. 8 is a plan view of the tie of FIG. 7.

A double hat-shaped section 36, as shown in FIGS. 7 and 8, may also be utilized for exceptionally heavy rail, in which case each of the bases 36*b* thereof is provided with the pairs of holes 14 and two pairs of tie plates 18 and two fastening members 26 are required at each end of the tie 36.

Figure 10:
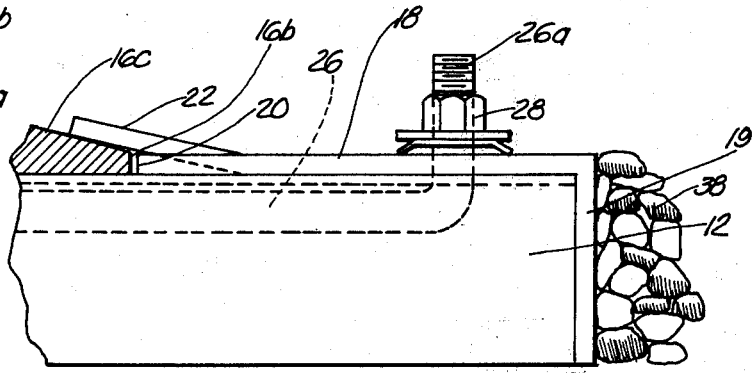
FIG. 10 is a fragmentary side elevational view, partially in section, of a tie plate fastener system incorporating a tie plate having an end closure.

As shown in FIG. 10, a variation of the outermost one of a pair of tie plates 18 includes a depending flange end closure or vertical return 19 which is contiguous with the end of its respective tie 12, 34, 36, to further protect the tie 12, 34, 36, and to increase the stability of the tie 12, 34, 36 for curved track.

It should, perhaps, be noted that with the exception of the outer tie plate 18 of FIG. 10, which incorporates an end closure or vertical return 19 adjacent the end of the tie 12, 34, 36, the outer tie plates 18 need not completely extend from a rail 16 to the end of a tie 12, 34, 36.

During installation it has been found that the most efficient method of laying the steel ties 12, 34, 36 is to loosely assemble underground the tie plates 18 to the ties 12, 34, 36 by means of the fastening means 26 extending through each of the pairs of openings 14 prior to placement of the spaced ties 12, 34, 36 on the waste rock ballast 38. In practice, the ties 12, 34 and 36 do not require the use of special ballast material, and small waste rock is adequate to provide bearing support.

The railroad bed should be prepared by grading the waste rock ballast 38 a few inches above the required grade. The pre-assembled steel ties 12, 34, 36 are then placed at the spacing desired in the ballast material 38. The placed ties 12, 34, 36 can be worked into the ballast by hand, first removing all obstructing rock at the channel legs 12*a*, 34*a*, 36*a*.

The inside tie plate 18 should be in its approximate final position but the outside tie plate 18 should be rotated clear of the position of the rail 16.

When the ties 12, 34, 36 are in approximate line, which can readily be determined because the ties 12, 34, 36 are provided with means 40 thereon for indicating the longitudinal center thereof, which means preferrable comprises an opening through the base 12*b*, 34*b*, 36*b* of the ties 12, 34, 36, and preliminary grade (i.e., an inch or two above final grade), the two rails 16 to be positioned, lying adjacent to the previously laid track, are pushed carefully forward across the steel ties 12, 34, 36 by the evacuation equipment and then barred into position in the tie plates 18.

The outside tie plates 18 are then rotated so that the edge portions 20 of each plate lie substantially adjacent the edges or sides 16*b* of the base 16*a* of the rail 16 and the central raised and elongated portions 22 overlie the upper surface 16*c* of the rail base 16*a*. The bolts 28 (and also 32 if a hook shaped end 30 is not utilized) are then slightly tightened, after which a locomotive or self-propelled mining equipment is moved slowly across the new track to position the rail 16 on accurate operating gauge and seat the track on grade. The locomotive or self-propelled mining equipment is then reversed to its original position and all the bolts 28 (and also 32 if a hook shaped end 30 is not utilized) are fully tightened. As a final operation, loose rock is shovelled over the ties 12, 34, 36 so as to provide a cushion against blasting and excessive unnecessary direct abrasion or damage.

It has been found that 30 foot sections of track, which normally take 3 to 4 hours to lay with timber ties, can be easily installed in approximately 1½ hours with ease and safety.

The ties 12, 34, 36 of the present invention are generally suitable for various gauges found in mines in North America. The standard tie lengths are 4 feet 8 inches, and 5 feet 8 inches. This length is suitable for most gauges.

In the modern heavy tramming systems underground, rail weights and profiles vary somewhat; however, the standard tie plates 18 and bolts 28, 32 are so designed to accommodate the most commonly used rails. In general, rails weighing between 60 pounds and 85 pounds, per yard. However, lighter rail can be accommodated by minor modification to the tie plates 18.

It should, perhaps, be noted that provision may be made in the basic tie 12, 34, 36 for slotting the outer set of holes 14 only, which permits the development of a maximum of ½ inch of gauge widening on the outer rail 16 to accommodate sharply curved track layouts. Special tie plates 18, which include vertical returns, may be supplied for curved track to increase the stability of the tie 12, 34, 36.

The steel ties 12, 34 and 36 may be used with conventional track drifting techniques where mining equipment is operating at the drift face on slide rails.

It has been found that ties 12, 34, 36 and tie plates 18 of black, copper bearing steel, are adequate for required service life. However, the ties, 12, 34, 36 and the tie plates 18 can be of galvanized material. Additionally, in mines where there is extreme corrosion and such practices are permissible, field coating with a light asphaltic emulsion will further extend the surface life of the ties 12, 34, 36 and tie plates 18.

It is the intention to include all embodiments and modifications of the invention as are defined by the appended claims within the scope of the invention.

I claim:

1. A tie plate fastener system for connecting a pair of spaced rails to a tie comprising:

a. a metallic channel tie of U-shaped cross section with the legs thereof opening downwardly and the base thereof having at each end at least one pair of openings spaced from the edges of a rail base when in position on said tie;

b. a pair of tie plates for each said rail located on either side thereof, each tie plate having forward edge portions lying substantially adjacent the sides of said rail base and a central raised and elonated portion overlying the upper surface of said rail base, said tie plates being of a width substantially identical to the width of said tie and of a length to be provided with openings therethrough in positions corresponding to said openings in said tie; and c. a single fastening means extending through each said at least one pair of openings for securing said pair of tie plates, and thus its respective rail, to said tie, said fastening means comprising a U-bolt, having an elongated base and upstanding legs, said legs being of a length just sufficient to enable mounting of said U-bolt with said elongated base portion thereof lying just under the underside of the base of said channel tie, the free end of one of said legs being threaded and provided with a nut and the free end of the other of said legs being hooked-shaped, with said hook-shaped end extending outwardly and away from said rail, said hook-shaped end and said nut bearing against the said tie plates and securing them tightly against said base of said channel tie, whereby said tie plates and said single fastening means results in a more positive connection of said rail to said tie and thus reduces rail spreading.

2. The tie plate fastener system according to claim 1, wherein said at least one pair of openings in the base of said tie are spaced at least twice the width of the base of said rail to preclude damage to said fastener means by virtue of derailment.

3. A tie plate fastener system according to claim 1, wherein said channel tie is hat-shaped in cross section.

4. A tie plate fastener system according to claim 1, wherein said tie comprises a double hat-shaped section.

5. A tie plate fastener system according to claim 4, wherein a pair of openings spaced from the edges of said rail base when in position on said tie is provided at each end of each said base of said hat sections.

6. A tie plate fastener system according to claim 1, wherein a second pair of openings is provided in the base of said tie spaced from the edges of said rail, and wherein a second single fastening means extends through said second pair of openings.

7. A tie plate fastener system according to claim 1, including means on said tie for indicating the longitudinal center thereof.

8. A tie plate fastener system according to claim 7, wherein said means on said tie for indicating the longitudinal center thereof comprises an opening through said base.

9. A tie plate fastener system according to claim 1, wherein the outer opening of said at least one pair of openings is slotted to permit gauge widening on the outer rail to accommodate sharply curved track layouts.

10. A tie plate fastener system for connecting a pair of spaced rails to a tie comprising:

a. a metallic channel tie of U-shaped cross section with the legs thereof opening downwardly and the base thereof having at each end at least one pair of openings spaced from the edges of a rail base when in position on said tie;

b. a pair of tie plates for each said rail located on either side thereof, each tie plate having forward edge portions lying substantially adjacent the sides of said rail base and a central raised and elongated portion overlying the upper surface of said rail base, said tie plates being of a width substantially identical to the width of said tie and of a length to be provided with openings therethrough in positions corresponding to said openings in said tie, the end of the outermost one of said tie plates being provided with a depending flange which is contiguous with the end of its respective tie so as to increase the stability of said tie; and c. a single fastening means extending through each said at least one pair of openings for securing said pair of tie plates, and thus its respective rail, to said tie, whereby said tie plates and said single fastening means results in a more positive connection of said rail to said tie and thus reduces rail spreading.

* * * * *